US010041157B2

(12) United States Patent
Kolbe et al.

(10) Patent No.: US 10,041,157 B2
(45) Date of Patent: Aug. 7, 2018

(54) LOW-ALLOYED STEEL AND COMPONENTS MADE THEREOF

(71) Applicant: Gesenkschmiede Schneider GmbH, Aalen (DE)

(72) Inventors: Peter Kolbe, Aalen (DE); Ernst-Peter Schmitz, Abtsgmünd (DE); Thomas Körner, Schwelm (DE); Ottmar Schwarz, Essingen (DE)

(73) Assignee: Gesenkschmiede Schneider GmbH, Aalen (DE)

( * ) Notice: Subject to any disclaimer, the term of this patent is extended or adjusted under 35 U.S.C. 154(b) by 540 days.

(21) Appl. No.: 13/744,828

(22) Filed: Jan. 18, 2013

(65) Prior Publication Data

US 2013/0189146 A1 Jul. 25, 2013

(30) Foreign Application Priority Data

Jan. 19, 2012 (DE) ..... 10 2012 100 444
Nov. 30, 2012 (DE) ..... 10 2012 111 679

(51) Int. Cl.

| | |
|---|---|
| ***C22C 38/22*** | (2006.01) |
| ***C22C 38/28*** | (2006.01) |
| ***C22C 38/32*** | (2006.01) |
| ***C22C 38/34*** | (2006.01) |
| ***C21D 9/00*** | (2006.01) |

(52) U.S. Cl.

CPC ..... *C22C 38/34* (2013.01); *C21D 9/00* (2013.01); *C22C 38/22* (2013.01); *C22C 38/28* (2013.01); *C22C 38/32* (2013.01)

(58) Field of Classification Search

None

See application file for complete search history.

(56) References Cited

U.S. PATENT DOCUMENTS 1,401,925 A * 12/1921 Sargent ..... C22C 38/12 420/118
5,846,344 A 12/1998 Kawaguchi et al.
2010/0018613 A1* 1/2010 Novotny ..... C21D 6/004 148/332

(Continued)

FOREIGN PATENT DOCUMENTS

DE 196 44 517 A1 4/1997
EP 1741798 A1 * 1/2007

(Continued)

OTHER PUBLICATIONS

Machine-English translation of Japanese patent No. 10-076370, Yamashita Eiji et al. Mar. 24, 1998.*

(Continued)

*Primary Examiner* — Deborah Yee
(74) *Attorney, Agent, or Firm* — David S. Safran

(57) ABSTRACT

A low-alloyed steel, comprising about 0.3 to about 0.50 wt. % carbon, about 2.0 to about 5.0 wt. % silicon, and a remainder of iron, optionally containing low amounts of molybdenum, titanium and/or boron, with up to about 0.5 wt. % impurities. The low-alloyed steel is useful for making structural components having a tensile strength of greater than about 1000 to about 2000 MPa, a yield strength of greater than about 700 to approximately 950 MPa; a break elongation of greater than about 17% and a scaling resistance of greater than about 650° C.

6 Claims, 2 Drawing Sheets

(56) References Cited

U.S. PATENT DOCUMENTS

| | | | | |
|---|---|---|---|---|
| 2010/0043928 | A1 | 2/2010 | Sung | |
| 2010/0086432 | A1* | 4/2010 | Sugimura | C21C 7/06 420/83 |
| 2010/0224287 | A1* | 9/2010 | Kochi | C22C 38/002 148/504 |

FOREIGN PATENT DOCUMENTS

| | | | | |
|---|---|---|---|---|
| EP | 1 961 832 | A1 | 8/2008 | |
| GB | 2 173 216 | A | 10/1986 | |
| JP | 62-112753 | * | 11/1985 | C22C 38/12 |
| JP | 2004-263247 | A | 9/2004 | |
| WO | 2011/030853 | A1 | 3/2011 | |
| WO | 2012/093506 | A1 | 7/2012 | |

OTHER PUBLICATIONS

Machine-English translation of JP 62-112753, Mizuno Shinya et al. May 23, 1987.*

* cited by examiner

LOW-ALLOYED STEEL AND COMPONENTS MADE THEREOF

BACKGROUND OF THE INVENTION

Field of the Invention

The invention relates to a low-alloyed steel having excellent processability and scaling resistance, as well as components and parts made thereof In particular, the present invention is directed to steel for forming parts which provides the formed parts with good scaling resistance, as well as components made thereof Low-alloyed steels are steels in which no alloying element exceeds a median content of 5 mass percent.

Description of Related Art

Steel alloys are defined according to the following rules: Because iron (Fe) is well-known to comprise the majority of the alloy, it is typically left-out of the formula. The first position indicates the carbon content in mass percent multiplied by 100, followed by the chemical symbols of the alloying elements in the order of decreasing mass fractions, and at the end, in the same order and separated by hyphens, the mass fractions of the previously indicated alloying elements, which are multiplied by the following factors in order to arrive at larger integers:

×1000: B

×100: C, N, P, S, Ce

×10: Al, Cu, Mo, Ti, V, Be, Ta, Zr, Nb, Pb

×4: Cr, Co, Mn, Ni, Si, W.

In all instances Fe comprises the remainder of the alloy. In cases where an alloying element is present, but at amounts which are not meaningful, the number referring to their content can be omitted.

Because steels with particularly low carbon content have excellent processing properties, more recently they have been used extensively for forming parts, especially for vehicles, machine engineering, construction of large engines etc. Workpieces for forging are usually obtained by decarbonisation of molten steel, which has been produced by a converter etc., where e.g. a vacuum-degassing method, such as the Ruhrstahl-Haereus (RH) method, is used in order to lower the carbon concentration to a particularly low level. Afterwards, usually continuous casting is performed. For forming applications, 42CrMo4 IM (inclusion modified) steel or 43 CrMo4 has often been used as low-alloyed steel.

Conventional 42CrMoS4 IM steel has the following composition:

| Chemical composition | Min (wt. %) | Max (wt. %) |
|---|---|---|
| C | 0.38 | 0.45 |
| Si | | 0.40 |
| Mn | 0.70 | 0.90 |
| P | | 0.035 |
| S | | 0.035 |
| Cr | 0.90 | 1.20 |
| Mo | 0.15 | 0.30 |

In the hardened and tempered state, 42CrMo4 IM steel has a tensile strength of 900 to approximately 1200 MPa, and a yield strength of at least 650 MPa. This steel has the following advantages: Inclusions are less abrasive, acting like lubricants and barriers at the contact points of tool and workpiece. Compared to the standard class of the IM steels, they already result in better cutting properties with reduced processing costs up to 30% longer lifetime for a specific cutting speed up to 30% higher cutting speeds for a specific lifetime.

The alloying components of the steel used in the known alloy have the following effects, among others.

Carbon lowers the melting point and increases the hardness and tensile strength through formation of Fe3C. In higher amounts it increases the brittleness and lowers the forgeability, weldability, fracture strain and notch impact strength. Likewise, the malleability is lowered when carbon is added in higher amounts and it must therefore be added in lower amounts.

Chrome lowers the critical cooling rate and increases wear resistance, high temperature strength, and scaling resistance. The tensile strength is increased, as chrome acts as a carbide binder. From 12.2 wt. % and above, it increases corrosion resistance (stainless steel) and has a ferrite-stabilizing effect. Unfortunately, it lowers notch impact strength and weldability and decreases thermal and electric conductivity. Through the addition of chrome, the best results in effective hardness and hardness penetration are achieved.

Molybdenum enhances hardenability, tensile strength and weldability. Unfortunately, it decreases ductility and malleability. Molybdenum also increases hardening properties and advantageously complements chrome. In addition, Mo enhances the high temperature strength as well as tempering resistance, a property which is especially important when it comes to tempering.

Sulphur increases machinability, but lowers the ductility and thus the malleability of the iron alloy.

A conventional heat treatable steel 41CrS4, which is used for the same purposes, consists of:

| Chemical composition | Min (wt. %) | Max (wt. %) |
|---|---|---|
| C | 0.38 | 0.45 |
| Mn | 0.60 | 0.90 |
| Si | | 0.40 |
| S | | 0.40 |
| Cr | 0.90 | 1.2 |

The heat-treatable steel 41CrS4 is a versatile material and is mainly used in automotive engineering and vehicle construction. It is used for components for which strength requirements are not as high as for parts made of the heat-treatable steel 42CrMo4. 41CrS4 is hot-formed at 850° C. to 1310° C. and slowly cooled-down afterwards.

As 41CrS4 is hard to weld, it should not be used in welded constructions. In the hardened and tempered condition, 41CrS4 steel has a yield strength of 560 to 800 MPa and a tensile strength of 950 to 1200 MPa at room temperature.

The conventional steels 42CrMo4 and 41CrS4 are very versatile. With the described properties, the materials are suitable for high as well as extremely high dynamic stress and static loads. They are applied based on the required strength and ductile values. However, the dimensioning of components and parts always has to be considered. Especially in hot and cold forming processes, these steels have excellent mechanical machinability so that they are widely used in vehicle construction, machine engineering, construction of large engines etc. However, they do not have sufficient scale resistance for some applications (highly thermally-strained parts) and are also not sufficiently strong for light-weight steel construction.

Due to stricter environmental legislation, especially in the USA, in order to achieve a reduction of pollutants in exhaust gases, the pressures and consequently also the temperatures in the combustion chamber of diesel engines had to be increased. According to the new and stricter conditions for Ferrotherm pistons, the temperatures in the combustion chamber could reach up to about 500° C., with the temperatures probably being a little lower in the interior of the piston.

Aluminium alloys which have often been used in cars are less and less able to meet the necessary load increases. Here, a two-part solution presented itself, consisting of a highly loaded piston head part and the piston skirt. As a standard material for the piston head, the material 42CrMo4 is often selected in a tempered version. The strength of these components lies between about 870 and about 1080 MPa. The high temperature strength, alternating load resistance, thermal shock stability and oxidation resistance of these heat-treatable steels are also just sufficient for the present conditions.

Because scale resistance needs to be improved for the new applications and also with view to the high prices for these conventional steels, which particularly arise through addition of Mo, the creation of steel with better mechanical properties is desired. So far it has been assumed that for:

up to 400° C., the use of unalloyed and manganese-alloyed steels is adequate;

up to 550° C., the use of Mo(—V)-alloyed steels is adequate;

up to 600° C., the use of scaling-resistant steels, which are high-alloyed with Cr is appropariate; and for greater than 600° C., the use of high-alloyed, austenitic Cr—Ni steels is required. However, such high-alloyed steels are expensive.

Thus, only high-alloyed steels have been used as scaling resistant and high-temperature resistant steels, resulting in correspondingly high costs for the alloying elements.

Accordingly, one objective of the present invention is to enhance the scaling resistance of low-alloyed steels for highly thermally-stressed steel parts.

SUMMARY OF THE INVENTION

The invention accordingly relates to low-alloyed steel with the following alloy components:

from about 0.3 to about 0.50 wt. % carbon, preferably from about 0.35 to about 0.4 wt. % carbon;

from about 2.0 to about 5.0 wt. % silicon, preferably from about 2.5 to about 4 wt. % silicon; and the remainder being iron, as well as up to about 0.5 wt. % impurities.

In a preferred embodiment, such a steel with the following alloy contents including the addition of chrome is used:

from about 0.3 to about 0.50 wt. % carbon, preferably from about 0.35 to about 0.4 wt. % carbon;

from about 2.0 to about 5.0 wt. % silicon, preferably from about 2.5 to about 4 wt. % silicon;

from about 0.9 to about 1.2 wt. % chromium, preferably from about 1.0 to about 1.2 wt. % chromium, and especially preferred from about 1.1 to about 1.2 wt. % chromium; and the remainder being comprised of iron, as well as up to about 0.5 wt. % impurities.

It can be advantageous to also alloy the steel with molybdenum. In another embodiment, the invention is directed to a steel with the following alloy contents:

from about 0.3 to about 0.5 wt. % carbon, preferably from about 0.35 to about 0.4 wt. % carbon;

from about 2.0 to about 5.0 wt. % silicon, preferably from about 2.5 to about 4 wt. % silicon;

from about 0.9 to about 1.2 wt. % chromium, preferably from about 1.0 to about 1.2 wt. % chromium, and even more preferred from about 1.1 to about 1.2 wt. % chromium;

from about 0.0 to about 0.3 wt. % molybdenum, preferably from about 0.15 to about 0.3 wt. % molybdenum, and even more preferably from about 0.2 to about 0.3 wt. % molybdenum; and the remainder being comprised of iron, as well as up to about 0.5 wt. % impurities.

In some cases, addition of titanium and boron is advantageous, resulting a steel alloy of the following composition:

from about 0.3 to about 0.5 wt. % carbon;

from about 2.0 to about 5.0 wt. % silicon;

from about 0.9 to about 1.2 wt. % chromium;

from about 0.0 to about 0.3 wt. % molybdenum, preferably from about 0.15 to about 0.3 wt. % molybdenum, and even more preferably from about 0.2 to about 0.3 wt. % molybdenum;

from about 0.02 to about 0.04 wt. % titanium, preferably from about 0.03 to about 0.04 wt. % titanium;

from about 0.001 to about 0.006 wt. % boron, preferably from about 0.002 to about 0.005 wt. % boron; and the remainder being comprised of iron, as well as up to about 0.5 wt. % impurities.

In the following, the invention is described in more detail by referring to the drawings as well as by using examples of embodiments, to which, however, it is in no way limited.

DETAILED DESCRIPTION OF THE INVENTION

Figure 1:
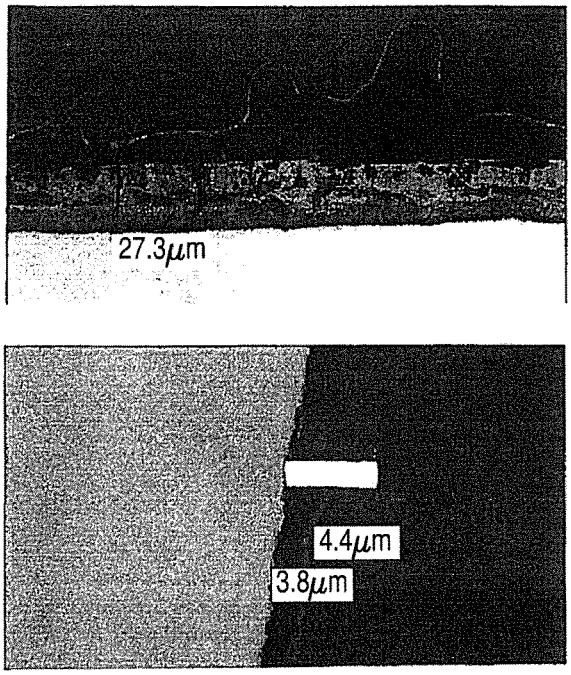
FIG. 1 shows a cut of two samples which have been annealed in an oven for 5 hours at 700° C., respectively, in a controlled oxygen atmosphere.

The steels according to the invention contain at least about 92.00 wt. % iron, preferably at least about 96.00 wt. % iron, and uncharacteristically from about 2.0 to about 5.0 wt. % silicon. It is advantageous to keep impurities and unavoidable elements at a concentration of under about 0.10% weight, preferably under about 0.05% weight.

Due to the addition of Si, costs for the steel according to the invention are approximately the same as for 42CrMo4 . However, in the case of the former, at the same time a considerable increase in scaling resistance by about 100° C. to about 150° C. and more as well as in yield strength is achieved. In steels according to the invention, yield strength is increased by approximately 100 MPa, accompanied by a slight decrease of the fracture strength. Machinability is not affected and can be performed by using the usual tools and methods.

A typical steel according to the invention has the following composition:

| Chemical composition | Min (wt. %) | max (wt. %) |
|---|---|---|
| C | 0.38 | 0.45 |
| Cr | 0.9 | 1.20 |
| Mo | 0 | 0.3 |
| Ti | 0.020 | 0.04 |

-continued

| Chemical composition | Min (wt. %) | max (wt. %) |
|---|---|---|
| Si | 3.0 | 6.0 |
| B | 0.002 | 0.005 |

Typical representatives of this group are steels designated herein as "42TBSi" and "41TBSi".

The now newly introduced alloying components have the following effects.

Silicon increases the scaling resistance, is a mixed-crystal-solution hardening agent and inhibits the formation of carbide. During steel manufacturing, it renders the molten mass more fluid and also acts as a reducing agent. Further, it increases tensile strength, yield strength as well as scaling resistance and has a ferrite stabilizing effect. Added in too high amounts, it reduces malleability of the alloy.

Through TiC formation, titanium prevents the inter-crystalline corrosion in iron alloys. Being a powerful nitride binder, it serves, among other things, for the protection of boron through the reaction with nitrogen. For example, when nitrogen is bound with titanium, a satisfying hardenability in the temperature range up to about 1000° C. occurs when the steel contains approximately 5 to 20 ppm boron. Ti is used for deoxidation of the steel and for fixation of C and N in the form of TiC or TiN, respectively. Therefore, Ti content should be at least about 0.02%. However, because a saturation effect occurs with regard to the action caused by Ti addition as soon as the Ti content exceeds about 0.08%, the upper limit of the Ti content is defined as about 0.08%.

Even when added in only very small amounts, boron increases the yield strength and the strength of the steel. It also acts as a neutron absorber and makes the steel suitable for nuclear power plant applications and the like. Addition of boron in an amount of up to about 0.01% in austenitic steels also enhances their high thermal stability. Boron steels are high-quality cold-forming steels. The alkaline effect of boron in steel results in an enhanced hardenability, which already has an effect at very low concentrations of about 0.0010% boron. In small amounts of up to about 100 ppm, boron also increases hardenability more than other, more expensive elements which have to be used in much higher amounts.

An outstanding feature of boron steels is the enhanced hardenability effected by the addition of even minute amounts of boron between about 3 and about 15 ppm. The amount of boron is critical, as an excessive amount thereof (>30 ppm) can lower the toughness and lead to embrittlement and hot shortness. The effect of boron on the hardenability also depends on the amount of carbon contained in the steel, with the effect of boron increasing inversely proportional to the percentage of the present carbon.

Boron can also be ineffective if its condition is altered through faulty heat treatment. For example, a high austenitization temperature, and temperature ranges, in which specific boron precipitates occur, are to be avoided.

Generally, the hardenability of steel is to a great extent ascribable to the effects of oxygen, carbon and nitrogen in steel. Boron reacts with oxygen to become boron trioxide ($B_2O_3$); with carbon to become iron boron cementite ($Fe_3(CB)$) and iron boron carbide ($Fe_{23}(CB)_6$) and with nitrogen to become boron nitride (BN). Loss of boron can occur through oxygen. The hardenability of boron steel is also closely connected to the austenitic conditions and normally decreases through heating to over 1000° C. Boron steels also have to be tempered at a lower temperature than other alloyed steels with the same hardenability.

The use of boron steels is advisable when the basic mass meets the mechanical requirements (toughness, wear resistance, etc.), but the hardenability is not sufficient for the planned cut size. Instead of higher alloyed and thus more expensive steel, the corresponding amounts of boron can be used, so that a suitable hardenability can be achieved.

A typical application for the steels of the present invention is for structural components, especially machine components having a tensile strength of >950 to about 1250 MPa, a yield strength of >700 to approximately 770 MPa, a break elongation of >10% and a scaling resistance of approximately 600° C. to about 650° C. and more.

Typically, such components include machine components, such as combustion engine components including but not limited to pistons, crank shafts, connecting rods, and valve parts, or other automotive components such as steering parts, conveyor parts especially for warm parts, power plant components, replacement parts for heat-resistant areas, steam turbine parts, combustion chamber parts for gas and oil burners, and exhaust systems and their related parts. The steels according to the invention are used for many other applications, such as wear-resistant materials and as high-strength steels. Examples are cutting tools, spades, knives, saw blades, safety carriers in vehicles etc.

The properties of the steels according to the invention as compared to those of known steels are:

| Property | 42CrMo4/41CrS4 | 41TBSi | 42TBSi |
|---|---|---|---|
| tensile strength (MPa) | >900 to 1100 | 950 to 1150 | 1000 to 1200 |
| yield strength (MPa) | >650 | >700 | >750 |
| fracture strain | >12% | >10% | >10% |
| Scaling resistance | up to approx. 550° C. | approx. 600° C. | approx. 650° C. |
| heat treatment | QT | QT | QT |
| machinability | good | good | good |
| friction welding properties | good | | |
| analysis | DIN EN 10083 | DIN EN 10083 plus | |

Specific advantages of the steels according to the invention are good cold formability, prolonged tool service life for tools made thereof, better weldability due to the lower carbon equivalents, and lower annealing temperatures. This results in energy savings and good case hardening.

Exemplary Embodiment 1

A cast steel billet made of 41TBSi is forged into a piston for a combustion engine in the course of a forging process at 1150° C. The motor piston thus manufactured is equipped with a head in the usual manner and built into a hybrid motor (HVV motor). After 1500 operating hours, no scaling of the steel surface of the piston showed in the ignition area is detectable. In comparison, a different cylinder which was made of 42CrMo4, but was otherwise identical, showed considerable scaling signs after 800 operating hours.

Exemplary Embodiment 2

A cast steel billet made of 42TBSi is forged into a piston in the course of a forging process at 1150° C. The piston thus manufactured is deployed in the usual manner as a combustion chamber for a gas engine.

After a burning time of several months, no scaling of the steel surface of the piston showed in the firing/ignition area. In comparison, a different piston which was made of 42CrMoS4, but was otherwise identical, showed clear scaling signs after 70% of this runtime.

Exemplary Embodiment 3

A forged steel billet made of conventional 42CrMo4 as well as a steel billet of steel according to the invention (42CrMo4+4% Si+0.04 wt. % in Ti; and 0.005 wt. % in B) were transferred into an electric air circulating furnace and annealed in the oven for 5 hours at 700° C. The controlled circulating air atmosphere of ordinary air in the oven ensured that the oxygen content was kept constant. Two more samples made of conventional 42CrMo4 and the steel according to the invention were annealed for 5 hours in the same oven under the same conditions, but at 750° C. The tested steel billets both came from cast, forged ingots which had been forged down to 45 mm in diameter. FIG. 1, which in its top part depicts a cut of the 42CrMo4 steel after the annealing treatment at 700° C., and in its bottom part depicts a cut through the steel alloy according to the invention which was annealed under the same conditions, clearly shows that the scale layer is considerably thinner in the steel according to the invention than in the conventional 42CrMo4 steel without silicon addition (8 micrometers as compared to 30 micrometers), demonstrating that scaling in the Si steel material occurs considerably slower and to a lesser extent.

Figure 2:
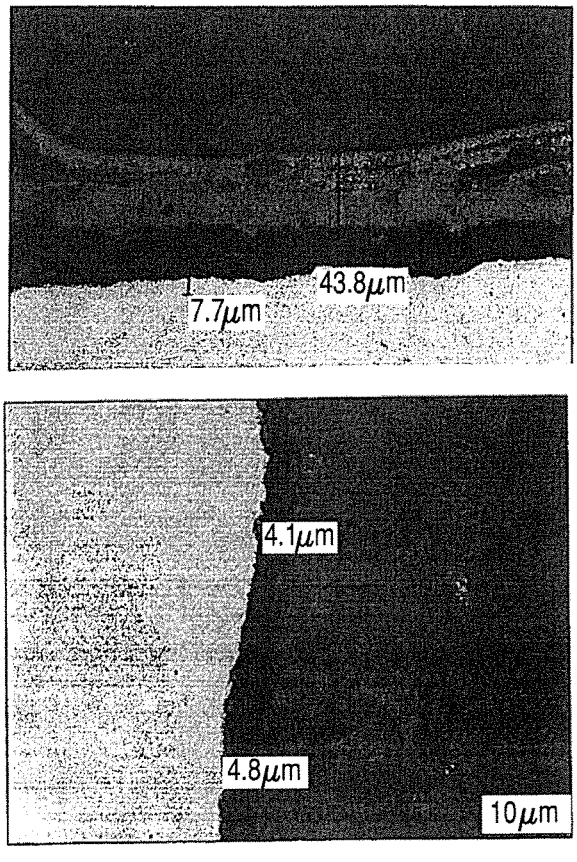
FIG. 2 shows a cut of two steel samples which have been annealed in an oven for 5 hours at 750° C., respectively, in a controlled oxygen atmosphere.

FIG. 2 shows the same steel billet submitted to an annealing treatment of 5 hours at 750° C. in the same air convection oven, where the upper sample is the 42CrMo4 steel, which has developed a thickened scale layer of max. 44 micrometers compared to the treatment at 700° C., while the steel according to the invention shows a thin scale layer of max. 5 micrometers.

This suggests that the silicon steel according to the invention is significantly less oxidized by oxygen at higher temperatures than conventional low-alloyed CrMo4 steel. This means that the steels according to the invention reach a scaling resistance which so far could only be achieved by using costly additives.

Figure 3:
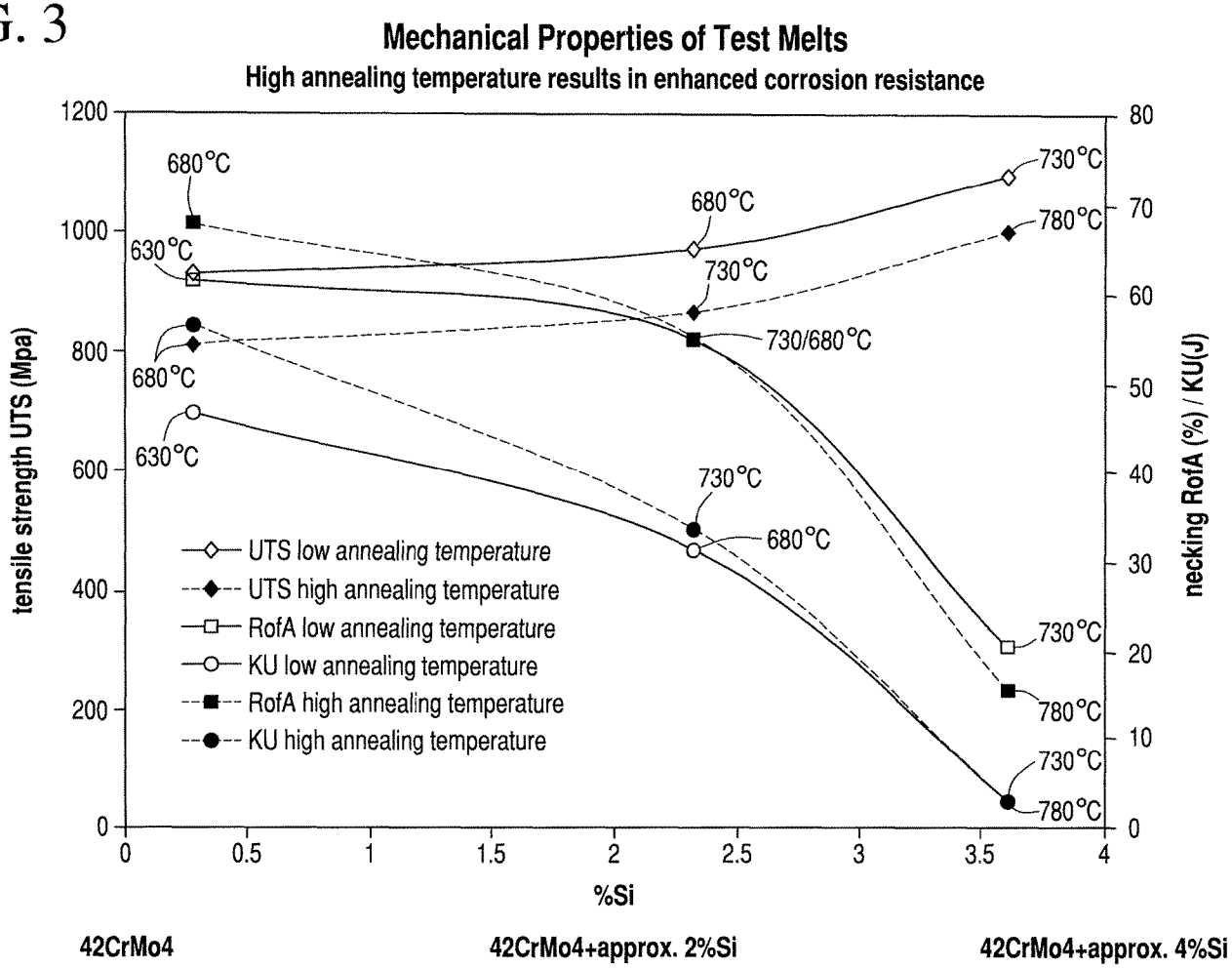
FIG. 3 is a representation of the notch impact strength, tensile strength, necking of steel samples against the silicon content of different 42CrMo4 alloys which have been tempered at different temperatures.

FIG. 3 graphically represents a list of characteristics of 42CrMo4 steels with silicon additions up to 4% as a function of the silicon content and the annealing temperature. The abscissa indicates the Si content of a basic alloy 42CrMo in wt. %, while the left ordinate shows the tensile strength UTS in MPa. The right ordinate indicates the notch impact strength (KU). Curves for necking RoFa (%) of the steel according to the invention are shown for low as well as high Si content. It is shown that necking and notch impact strength decrease, while the tensile strength values increase. The notch impact strength starts decreasing rapidly at Si contents of more than 2.5 wt. %. The characteristics also depend on the annealing temperature (low tempering/high tempering). The high annealing temperature was 680° C. around approximately 0.5% Si, while the low annealing temperature was 630° C. When approximately 2.5 wt. % in Si is added, the high annealing temperature was 730° C. and the low annealing temperature was 680° C. It becomes clear that with increasing Si content—even independently of the annealing temperature—the tensile strength increases while the necking and notch impact strength decrease. A higher annealing temperature lowers notch impact strength and necking RoFa, while the necking RoFa at a low silicon content is higher for steel tempered at a higher temperature than for a steel tempered at a lower temperature. This ratio of RoFa of steel tempered at a higher temperature and the RoFa of steel tempered at a higher temperature is reversed with increasing Si content, while at higher silicon content the notch impact strength becomes almost independent of the annealing temperature. The tensile strength increases with rising annealing temperature and Si content.

Accordingly the invention also relates to machine components or structural components with a tensile strength of about 1000 MPa and more for alternating mechanical strains up to a temperature of about 630° C., which are formed from a thermally quenched and tempered steel alloy. In particular, the invention relates to motor and/or drive components of vehicles.

In modern technology, other machine components with alternating mechanical and thermal strain are also exposed to increasing loads that reach the limits of the respective material resistance. This particularly applies to motors, as the weight reductions obtained here can also be used for saving fuel etc. The materials these components are made of have to comply with high requirements regarding the property profile, toughness, hardness and ductility values in the thermally quenched and tempered state, as these property values are of vital importance for the dimensional design of the parts. Because of the failure of parts in long-term operation, it has become evident that the properties of material fatigue also have to be considered in order to attain a high degree of operational safety.

Now the low-alloyed heat-treatable steels according to the invention can be used advantageously for parts with significant mechanical stress variation in the rail, automobile and aviation sectors. Use of steel alloys which have a composition that corresponds to those of heat-treatable steels of the previously mentioned kind has proven successful in the manufacture of highly stressed machine components, where their fatigue characteristics and thermal stability is adequate for alternating mechanical stress in the limit value range of the used materials.

The description of the invention is only exemplary in nature and variations which will be apparent to a person skilled in the art are intended to be within the scope of the invention, as defined by the claims.

What is claimed is:

1. A structural component made of a low-alloyed steel consisting of:

0.3 to 0.50 wt. % carbon;

4 wt. % silicon;

1. 0 to 1.2 wt. % chromium;

0.7 to 0.9 wt. % manganese;

0.15 to 0.3 wt. % molybdenum;

0.002 to 0.005 wt. % boron;

0.02 to 0.04 wt. % titanium;

a remainder of iron; and wherein the structural component has a tensile strength of greater than 1000 to 2000 MPa, a yield strength of greater than 700 to approximately 950 MPa; a break elongation of greater than 17% and a scaling resistance of greater than 650° C.

2. The low-alloyed steel according to claim 1, which has 0.35 to 0.4 wt. % carbon.

3. The low-alloyed steel according to claim 1, which has 1.1 to 1.2 wt. % chromium.

4. The low-alloyed steel according to claim 1, which has 0.2 to 0.3 wt. % molybdenum.

5. The low-alloyed steel according to claim 1, which has 0.03 to 0.04 wt. % titanium.

6. The structural component according to claim 1, selected from a group comprising pistons, crank shafts, connecting rods, steering parts, valve parts, conveyor parts, power plant components, replacement parts for heat-resistant areas, steam turbine parts, combustion chamber parts for gas and oil burners, and exhaust system components.

* * * * *